US008904617B2

(12) United States Patent
Carmody et al.

(10) Patent No.: US 8,904,617 B2
(45) Date of Patent: Dec. 9, 2014

(54) DIVERTING SYSTEM AND METHOD OF RUNNING A TUBULAR

(75) Inventors: Michael A. Carmody, Houston, TX (US); John J. Johnson, Montgomery, TX (US); Bryan P. Pendleton, Cypress, TX (US); John P. Roach, Lakewood, CO (US); Joseph Sheehan, Houston, TX (US); Barton Sponchia, Cypress, TX (US); Thomas J. Zweifel, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 1076 days.

(21) Appl. No.: 12/729,827

(22) Filed: Mar. 23, 2010

(65) Prior Publication Data

US 2011/0232063 A1 Sep. 29, 2011

(51) Int. Cl.

| | |
|---|---|
| ***B23P 19/12*** | (2006.01) |
| ***B23P 19/04*** | (2006.01) |
| ***E21B 41/00*** | (2006.01) |

(52) U.S. Cl.

CPC ..... *E21B 41/0035* (2013.01)

USPC ..... 29/407.09; 29/407.01; 166/255.3; 166/117.5; 166/380

(58) Field of Classification Search

USPC ..... 166/255.3, 117.5, 380; 29/407.01, 29/407.05, 407.09, 407.1

See application file for complete search history.

(56) References Cited

U.S. PATENT DOCUMENTS

| | | | | |
|---|---|---|---|---|
| 2,492,079 | A * | 12/1949 | Wiley | 166/117.5 |
| 2,719,024 | A | 9/1955 | Prescott et al. | |
| 4,295,528 | A | 10/1981 | Carmody | |
| 4,840,229 | A | 6/1989 | Proctor et al. | |
| 4,976,314 | A | 12/1990 | Crawford et al. | |
| 4,984,632 | A | 1/1991 | Sampa et al. | |
| 4,999,900 | A * | 3/1991 | Anderson | 29/407.01 |
| 5,388,648 | A * | 2/1995 | Jordan, Jr. | 166/380 |
| 5,439,061 | A * | 8/1995 | Brammer et al. | 166/368 |
| 5,474,131 | A | 12/1995 | Jordan, Jr. et al. | |
| 5,857,524 | A | 1/1999 | Harris et al. | |
| 5,971,073 | A * | 10/1999 | Longbottom et al. | 166/313 |
| 6,076,602 | A * | 6/2000 | Gano et al. | 166/298 |
| 6,079,493 | A * | 6/2000 | Longbottom et al. | 166/313 |
| 6,840,320 | B2 | 1/2005 | Dewey et al. | |
| 7,240,738 | B2 | 7/2007 | Pendleton | |
| 7,775,269 | B2 * | 8/2010 | Dennistoun et al. | 166/55 |
| 8,210,254 | B2 * | 7/2012 | Zweifel | 166/117.5 |
| 8,408,291 | B2 * | 4/2013 | Pendleton et al. | 166/208 |
| 2003/0183396 | A1 * | 10/2003 | Adams et al. | 166/382 |
| 2010/0326671 | A1 * | 12/2010 | Buytaert et al. | 166/378 |

OTHER PUBLICATIONS

William Clifford Hogg et al., "A New Low Risk Technique of Forming A Level 6 (TAML) Multilateral Junction"; Society of Petroleum Engineers, SPE Paper No. 50664; Oct. 20-22, 1998.

(Continued)

*Primary Examiner* — Peter DungBa Vo
*Assistant Examiner* — Kaying Kue
(74) *Attorney, Agent, or Firm* — Cantor Colburn LLP

(57) ABSTRACT

A method of running a first tubular within a second tubular includes running the first tubular into the second tubular past at least one lateral extending from the second tubular, running a diverting tool at the first tubular with the running of the first tubular, withdrawing the first tubular from the second tubular until an end of the first tubular is beyond a junction between the at least one lateral and the second tubular and, running the first tubular into the at least one lateral.

18 Claims, 5 Drawing Sheets

(56) References Cited

OTHER PUBLICATIONS

William S. Isaacson et al., "Level 5 Multilateral Completed on Alaska's North Slope: A Case History"; Society of Petroleum Engineers, SPE/IADC Paper No. 52869; Mar. 9-11, 1999.

A.M. Pasicznyk et al., "Case History of the World's First Level 5 Multilateral Completed from a Semisubmersible Rig"; Society of Petroleum Engineers, SPE Paper No. 56779; Oct. 3-6, 1999.

Erick Peterson et al., "Development and Installation of an Extended Reach Multilateral Junction"; Society of Petroleum Engineers, SPE/IADC Paper No. 119553; Mar. 17-19, 2009.

* cited by examiner

DIVERTING SYSTEM AND METHOD OF RUNNING A TUBULAR

BACKGROUND

Industries involving tubular systems such as the downhole completion industry, for example, sometimes have a need to run a tubular, such as a drillstring, within a main tubular, such as a borehole. Such systems sometimes have offshoots from the main tubular often referred to as laterals. At times, operators of these systems have a need to run into one or more of the laterals. Typical systems and methods to do such an operation require the tubular to be fully withdrawn from the main before running back into one of the laterals. Having to withdraw the tubular from the main before running it into a lateral causes an operator to incur economic penalties associated with added labor and lost time. Methods and systems that lessen such economic penalties are always well received by system operators.

BRIEF DESCRIPTION

Disclosed herein is a method of running a first tubular within a second tubular. The method includes, running the first tubular into the second tubular past at least one lateral extending from the second tubular, running a diverting tool at the first tubular with the running of the first tubular, then withdrawing the first tubular from the second tubular until an end of the first tubular is beyond a junction between the at least one lateral and the second tubular and finally running the first tubular into the at least one lateral.

Further disclosed herein is a diverting system. The diverting system includes, a first tubular, a second tubular receptive to the first tubular having at least one lateral extending therefrom, the first tubular is runnable into the second tubular as well as into the at least one lateral. Also included is an engaging device in operable communication with both the first tubular and the second tubular, and a diverting tool in operable communication with the engaging device configured to selectively divert the first tubular into the at least one lateral.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
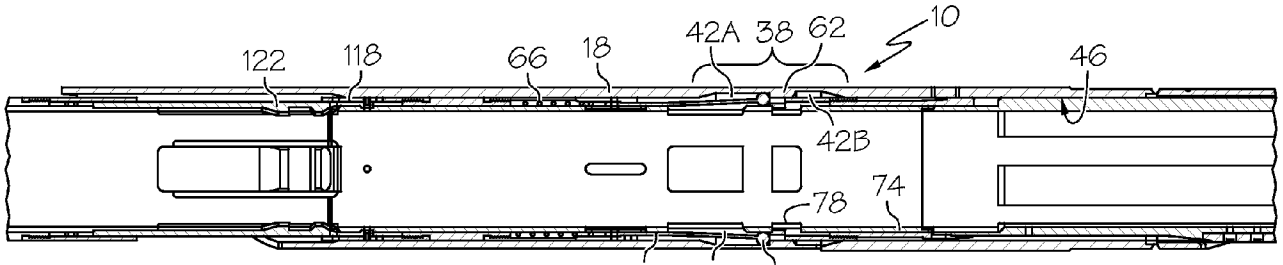
FIGS. 1A-1C depict a partial cross sectional view of a diverting system disclosed herein with the first tubular removed.
Figure 1B:
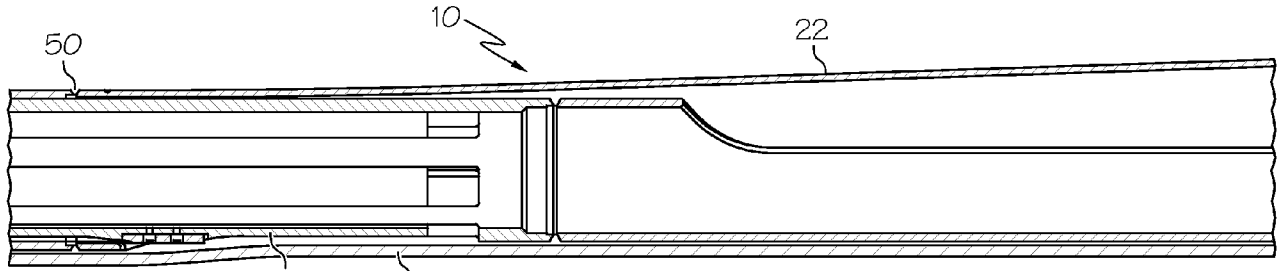
Figure 1C:
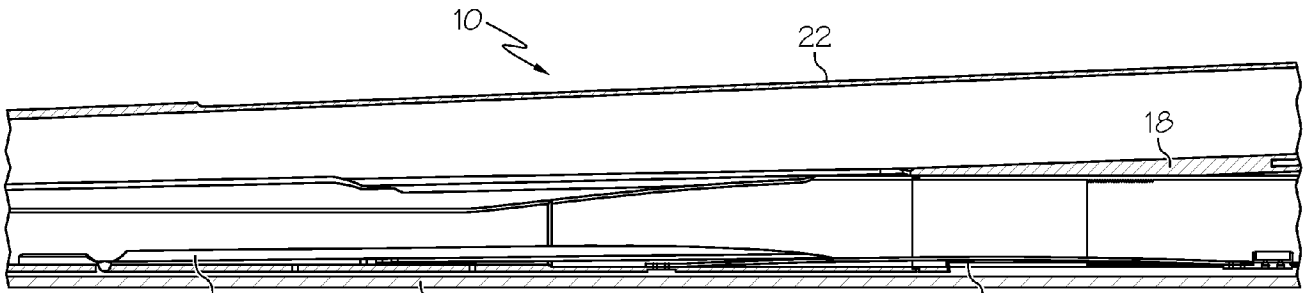

A detailed description of one or more embodiments of the disclosed apparatus and method are presented herein by way of exemplification and not limitation with reference to the Figures.

Embodiments of a diverting system disclosed herein allow a first tubular to run fully within a main of a second tubular and subsequently to run the first tubular into a plurality of lateral tubulars extending from the second tubular without having to withdraw the first tubular from the second tubular prior to doing so. In a downhole operation, for example, an operator could run a drillstring down a main wellbore past any number of laterals extending from the main wellbore. The operator could then sequentially run the drillstring into each of the laterals in succession starting with the lowest lateral and ending with the highest lateral, all during a single run of the drillstring. Optionally, the operator could choose to skip running the drillstring into any one or more of the laterals during the process.

Referring to FIGS. 1A-1C and 2A-2B, an embodiment of a diverting system is illustrated generally at 10. The embodiment of the diverting system 10 illustrated herein is deployed in a downhole application. The diverting system 10 includes a first tubular 14 (not shown in FIGS. 1A-1C to improve visual clarity of other components), shown as a drillstring, and a second tubular 18, shown as a main wellbore, having at least one lateral 22, shown as a lateral wellbore, extending from the second tubular 18. The second tubular 18 and the lateral(s) 22 are receptive to the first tubular 14 running therein. An engaging device 26 mounted at the first tubular 14 is selectively attached to the first tubular 14 and is slidable within the second tubular 18. A diverting tool 30, fixedly attached to the engaging device 26, is configured to selectively divert the first tubular 14 into one of the second tubular 18 and the lateral(s) 22 based on a selected sequence. The first tubular 14 maintains a ramp 28 of the diverting tool 30 in a non-diverting orientation until a sequence of events that will be discussed below are completed.

The diverting system 10 is configured such that the first tubular 14, as well as the engaging device 26 and the diverting tool 30 attached near an end 34 thereof, bypass all of the laterals 22 and continue running within the second main tubular 18 during the initial run in. A profile 38, defined by annular recesses 42A, 42B formed in an inner wall 46 of the second tubular 18 is positioned, in this embodiment, a fixed dimension above each junction 50, defined as the intersection of the second tubular 18 and each of the lateral(s) 22. Each time the engaging device 26 passes one of the profiles 38 in a downward direction, fingers 54 of a first collet 58 temporarily engage with a land 62 defined between the recesses 42A and 42B. This engagement moves the first collet 58 relative to the engaging device 26 compressing biasing members 66, shown herein as springs, in the process thereby allowing the fingers 54 to compress radially inwardly into window 70 in a body 74 of the engaging device 26. Once the fingers 54 have passed by the land 62 the biasing member 66 return the fingers 54 to their original positions. A force required to compress the biasing members 66 as the fingers 54 pass the land 62 can be detected by an operator feeding the first tubular 14 into the second tubular 18 thereby providing feedback as to dimensions from a surface, for example, to where each of the junctions 50 are located.

After all of the junctions 50 have been passed, and the first tubular 14 has been used to perform any desired functions in the second tubular 18 beyond the lowest lateral 22, withdrawal of the first tubular 14 can begin. Operator detection is again possible as the fingers 54 again engage the land 62, this time in the opposite direction of travel to that of the first time the fingers 54 engaged with the land 62. The biasing members 66 again allow the first collet 58 to move relative to the engaging device 26, this time in the opposite direction, to allow the fingers 54 to radially compress into windows 78 in the body 74.

Figure 3A:
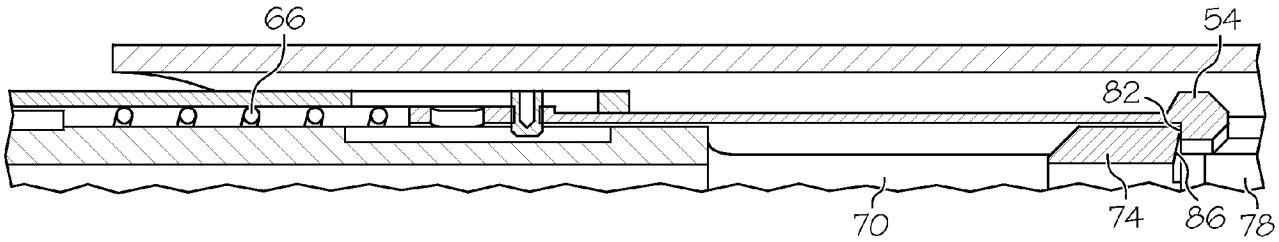
FIG. 3A depicts a magnified partial cross sectional view of an engaged collet of the diverting system of FIGS. 1A-1C.
Figure 3B:
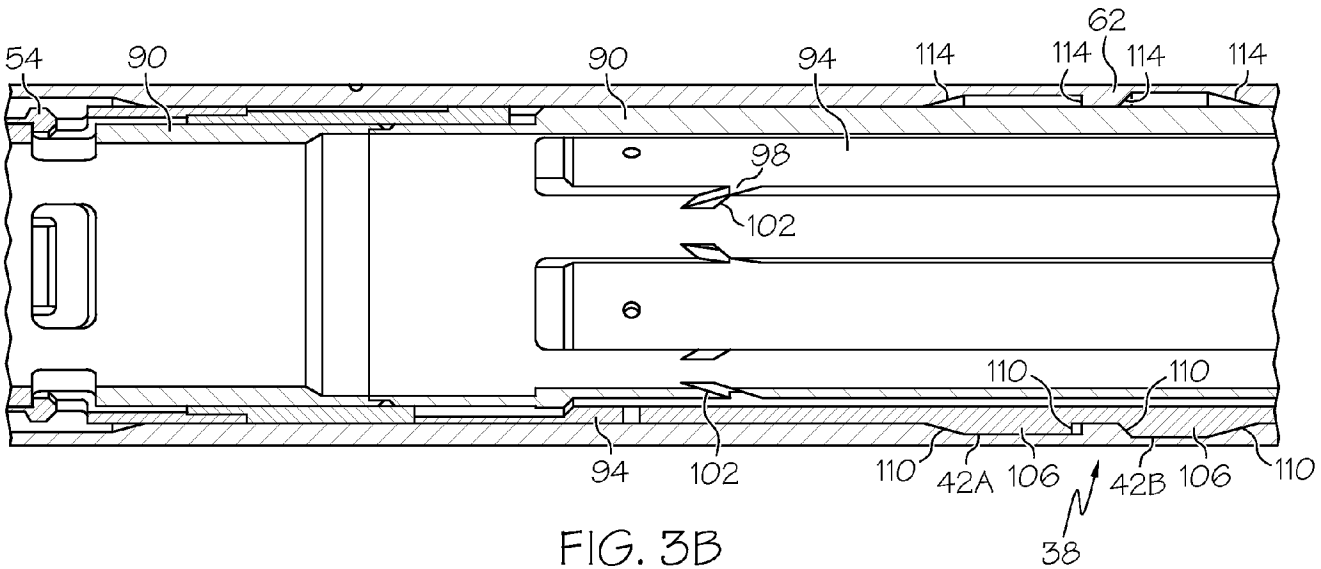
FIG. 3B depicts a magnified partial cross sectional view of radially expanded collect fingers of the diverting system of FIGS. 1A-1C.

Referring to FIGS. 3A and 3B, the fingers 54 have a back rake angle 82 that engage with a matching back rake angle 86 that cause the fingers 54 to remain engaged with the windows 78 even after the fingers 54 have passed the land 62. This permits the fingers 54 to pull sleeves 90 in an upward direction relative to collet fingers 94 that are attached to the engaging device 26 via urging by the biasing members 66. This relative movement between the sleeves 90 and the collect fingers 94 cause the collet fingers 94 to move radially outwardly in response to guides 98 on the collet fingers 94 riding within ramped surfaces 102 of the sleeves 90. With the collet fingers 94 being biased radially outwardly protrusions 106 on the collet fingers 94 are able to engage with the profile 38.

Surfaces 110 that define longitudinal ends of the protrusions 106 and surfaces 114 that define longitudinal ends of the profile 38 are angled to allow the protrusions 106 to ramp out to allow engagement with the profile 38 when protrusions 106 are moved in an upward direction, as illustrated herein, relative to the profile 38 but to longitudinally lock when moved in the opposing direction. The momentary engagement of the protrusions 106 with the profile 38 in the upward direction allows an operator to detect when such engagement and release occurs. Additionally, the engaging device 26 and the first tubular 14, when the two are locked together as will be discussed below, can be supported by the engagement of the protrusions 106 with the profile 38 in the downward direction, thereby providing additional confirmation of location of the junction 50.

Figure 2A:
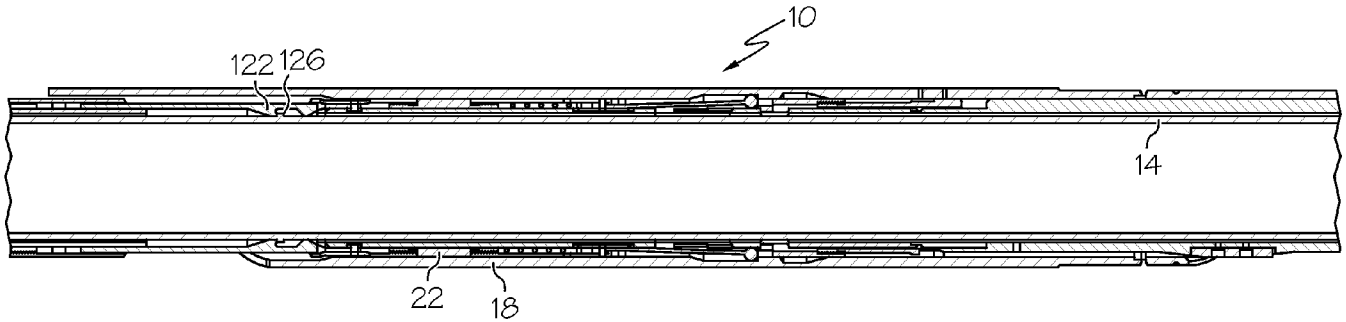
FIGS. 2A-2B depict a similar partial cross sectional view to that of FIGS. 1A-1C with the first tubular shown.
Figure 2B:
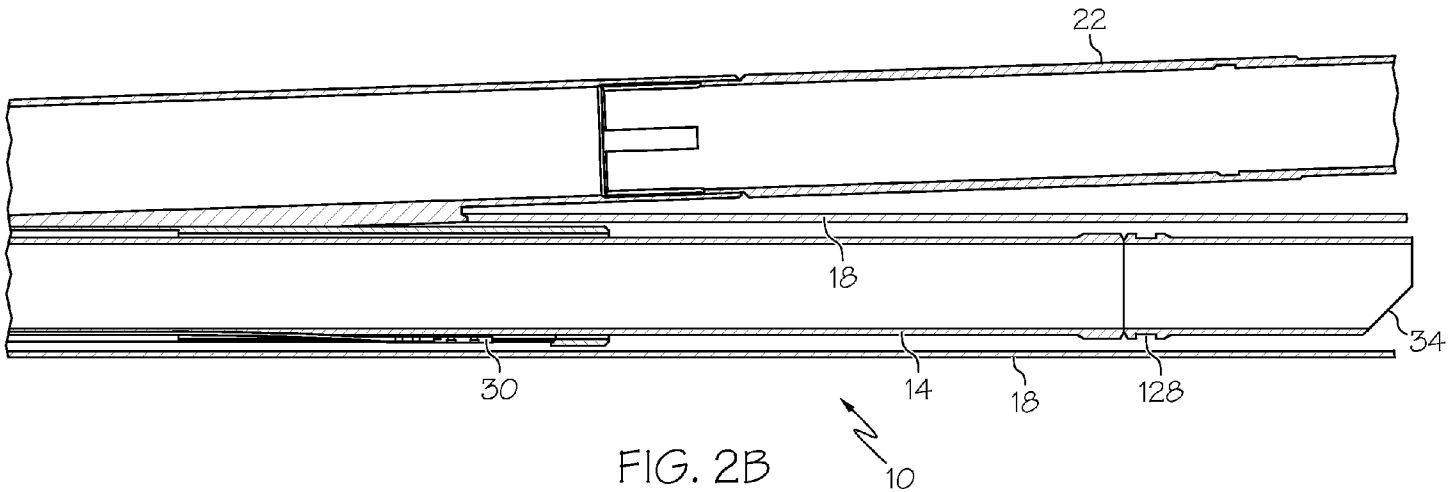
Figure 4:
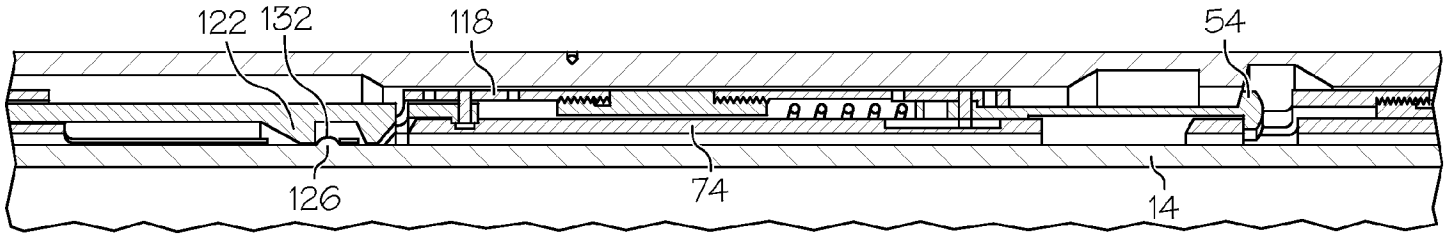
FIG. 4 depicts a partial cross sectional view of a collet engaged with a first profile of the first tubular.
Figure 5:
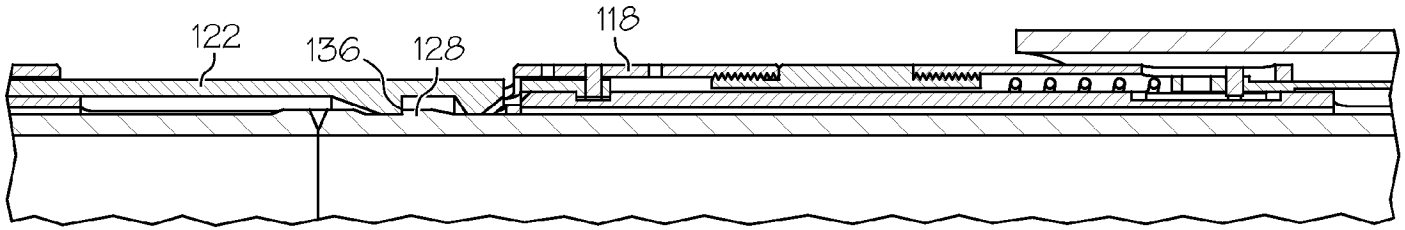
FIG. 5 depicts a partial cross sectional view of the collet of FIG. 4 engaged with a second profile of the first tubular.

Referring to FIGS. 4 and 5, the movement of the fingers 54 relative to the body 74 discussed above also causes collar 118 to move relative to the body 74. This movement removes the radial outward support provided by the collar 118 to collet 122 as illustrated in FIG. 1A. The collar 118 is illustrated in FIGS. 4 and 5 in the moved position where it is unsupportive of the collet 122. The collet 122 is engagable with details or profiles 126, 128 on the outside of the first tubular 14. The profile 126 is illustrated in FIG. 4 and the profile 128 is illustrated in FIG. 5. An upward facing surface 132 on the profile 126 is angled to cause the collet 122 to flex radially outwardly when urged thereagainst to allow the first tubular 14 to move upwardly relative to the engaging device 26. In contrast, an upward facing surface 136 on the profile 128 has a back rake angle designed to prevent the collet 122 from flexing radially outwardly in response to being urged thereagainst, thereby preventing upward movement of the first tubular 14 relative to the engaging device 26. The foregoing structure permits an operator to detect when the profile 126 has disengaged from the collet 122 and when the profile 128 has engaged with the collet 122. It should further be noted that the profile 128 is configured to permit disengagement with the collet 122 and movement of the first tubular 14 in a downhole direction relative to the collet 122. Additionally, the profile 128 is positioned along the first tubular 14 nearer to the end 34 than the profile 126 as is illustrated in FIGS. 2B and 2A respectively. Further, forces needed to engage the collet 122 with the profile 126 are less than the forces needed to disengage protrusions 106 from the profile 38. Likewise the force required to disengage protrusions 106 from the profile 38 is less than the forces needed to engage the profile 126 with the collet 122. These relationships are needed to assure that the first tubular 14 can be made to move relative to the engaging device 26 and one-trip access to each lateral 22 can be achieved.

Figure 6:
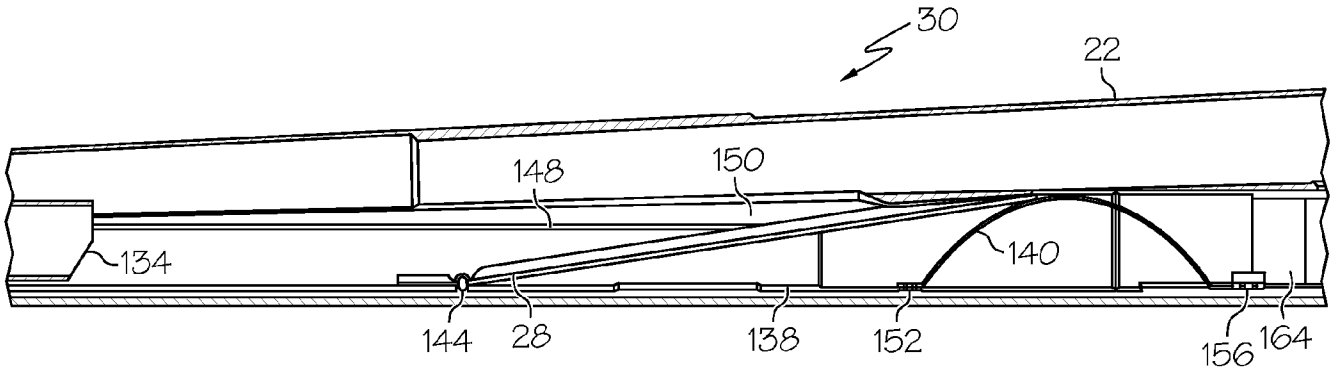
FIG. 6 depicts a partial cross sectional view of a diverter tool portion of the diverting system of FIGS. 1A-1C.
Figure 7:
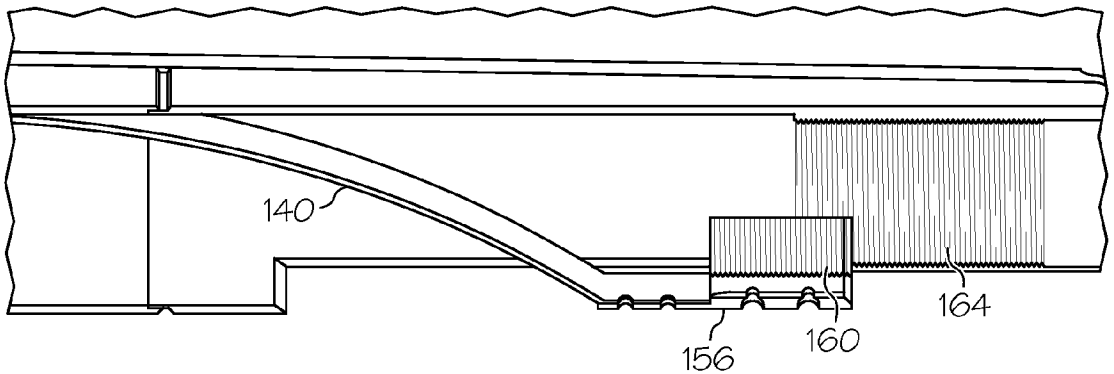
FIG. 7 depicts a partial cross sectional perspective view of an end of a biasing member of the diverter tool portion illustrated in FIG. 6.

Referring to FIGS. 6 and 7, a distance from the profile 128 to the end 34 is selected to assure that when the profile 128 is engaged with the collet 122 the end 34 is above the diverting tool 30 and more specifically above the ramp 28. Until this occurs the first tubular 14 has held the ramp 28 compressed against a body 138 of the diverting tool 30. A biasing member 140, illustrated herein as a bow spring, urges the ramp 28 to rotate in a counterclockwise direction, as shown in these figures, about a pivot 144. Contact between a lower end of the ramp 28 and the opposing wall of the body 138 limits this rotation. The ramp 28, when repositioned as shown in FIG. 6, is configured to divert the end 34 of the first tubular 14 through a window 148 in the body 138, and a window 150 in the second tubular 18 that define an entry into the lateral 22.

The biasing member 140 has a fixed end 152 and a movable end 156. As the biasing member 140 rotates the ramp 28 it bows thereby drawing the movable end 156 toward the fixed end 152. Teeth 160 often referred to as wickers, on the movable end 156 are engagable with complementary teeth 164, or wickers, on the body 138 that function as a ratcheting mechanism that only permits the movable end 156 to move in one direction. This ratcheting mechanism maintains the biasing member 140 in the bowed position and the ramp 28 in the fully rotated position to thereby divert the first tubular 14 through the window 148 whenever it is subsequently run thereagainst.

After the first tubular 14 has been run into the lateral 22 and completed any desired functions while therein, it can be withdrawn from the lateral 22. Withdrawal of the first tubular 14 continues until the profile 128 engages again with the collet 122 at which point continued upward movement of the first tubular 14 causes the engaging device 26, and the diverting tool 30 connected thereto, to move therewith relative to the second tubular 18. This movement continues until the operator detects that the collet fingers 94 have engaged with another of the profiles 38, thereby indicating that the engaging device 26 is located at another junction 50. Reversing direction of motion of the first tubular 14 to a downward direction then allows the engaging device 26 to become supported by the profile 38 via engagement therewith by the collet fingers 94. At such time relative movement between the first tubular 14 and the engaging device 26 begins again, resulting in the end 34 of the first tubular 14 encountering the ramp 28 and running into the newly encountered lateral 22.

The foregoing sequence can continue until the first tubular 14 has been run into each of the laterals 22. It should be noted that not all of the laterals 22 must be penetrated by the first tubular 14. In fact, any and even all of the laterals 22 could be skipped if desired. To do so an operator can simply continue to lift the engaging device 26 after detecting that the collet fingers 94 have engaged with one of the profiles 38. The lifting can continue until the collet fingers 94 engage with another of the profiles 38. However, once the collet fingers 94 have engaged a new one of the profiles 38 their engagement therewith prevents moving the engaging device 26 back down to a previously skipped or entered one of the laterals 22.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A method of running a first tubular within a second tubular, comprising:

running the first tubular into the second tubular past at least one lateral extending from the second tubular;

running a diverting tool at the first tubular with the running of the first tubular;

withdrawing the first tubular from the second tubular until an end of the first tubular is beyond a junction between a first of the at least one lateral and the second tubular but not beyond a junction between a second of the at least one lateral and the second tubular;

remotely sensing passage of the diverting tool past the at least one lateral during withdrawing of the first tubular; and running the first tubular into the first of the at least one lateral.

2. The method of running a first tubular within a second tubular of claim 1, further comprising positioning the diverting tool near an end of the first tubular.

3. The method of running a first tubular within a second tubular of claim 1, further comprising altering the diverting tool by withdrawing an end of the first tubular beyond at least a portion of the diverting tool.

4. The method of running a first tubular within a second tubular of claim 3, further comprising deploying a ramp with the altering of the diverting tool.

5. The method of running a first tubular within a second tubular of claim 4, further comprising biasing the ramp to the deployed position with a biasing member.

6. The method of running a first tubular within a second tubular of claim 5, further comprising locking the ramp in the deployed position with the biasing member.

7. The method of running a first tubular within a second tubular of claim 6, further comprising guiding the end of the first tubular into the at least one lateral with the ramp.

8. The method of running a first tubular within a second tubular of claim 1, further comprising remotely sensing passage of the diverting tool by each of the at least one lateral during the running of the first tubular.

9. The method of running a first tubular within a second tubular of claim 8, further comprising correlating a length of the first tubular run to a location of each of the at least one lateral with the remotely sensing.

10. The method of running a first tubular within a second tubular of claim 1, further comprising engaging collet fingers of an engaging device at the first tubular with at least one recess in the second tubular.

11. The method of running a first tubular within a second tubular of claim 1, further comprising supporting the diverting tool with a profile of the second tubular.

12. The method of running a first tubular within a second tubular of claim 10, wherein the sensing detects the engaging of the collet fingers within the at least one recess.

13. The method of running a first tubular within a second tubular of claim 10, further comprising disengaging the collet fingers from within the at least one recess.

14. A method of running a first tubular within a second tubular, comprising:

running the first tubular into the second tubular past at least one lateral extending from the second tubular;

running a diverting tool at the first tubular with the running of the first tubular;

engaging collet fingers of an engaging device at the first tubular with at least one recess in the second tubular during the running of the first tubular;

withdrawing the first tubular from the second tubular until an end of the first tubular is beyond a junction between a first of the at least one lateral and the second tubular but not beyond a junction between a second of the at least one lateral and the second tubular; and running the first tubular into the first of the at least one lateral.

15. The method of running a first tubular within a second tubular of claim 14, further comprising remotely sensing the engaging of the collet fingers with the at least one recess.

16. The method of running a first tubular within a second tubular of claim 14, further comprising disengaging the engaging of the collet fingers with the at least one recess.

17. The method of running a first tubular within a second tubular of claim 1, further comprising diverting the first tubular into the lateral with the diverting tool.

18. The method of running a first tubular within a second tubular of claim 1, wherein the running the first tubular into the lateral is without having withdrawn the first tubular fully from the second tubular.

* * * * *